United States Patent [19]

Walkhoff

[11] Patent Number: 4,539,763

[45] Date of Patent: Sep. 10, 1985

[54] ATHLETIC FOOTWEAR, IN PARTICULAR A SKI BOOT

[75] Inventor: Klaus Walkhoff, Kreuzlingen, Switzerland

[73] Assignee: Raichle Sportschuh AG, Kreuzlingen, Switzerland

[21] Appl. No.: 563,042

[22] Filed: Dec. 19, 1983

[30] Foreign Application Priority Data

Dec. 27, 1982 [CH] Switzerland ..... 7560/82

[51] Int. Cl.[3] ..... A43B 5/04

[52] U.S. Cl. ..... 36/120; 36/50

[58] Field of Search ..... 36/50, 117, 118, 119, 36/120, 121

[56] References Cited

U.S. PATENT DOCUMENTS

| | | | |
|---|---|---|---|
| 3,529,368 | 9/1970 | Canfield | 36/121 |
| 3,599,351 | 8/1971 | Check . | |
| 4,160,332 | 7/1979 | Salomon | 36/119 |
| 4,190,970 | 3/1980 | Annovi | 36/50 |
| 4,265,034 | 5/1981 | Salomon | 36/121 |

FOREIGN PATENT DOCUMENTS

| | | |
|---|---|---|
| 0053340 | 11/1981 | European Pat. Off. . |
| 2416660 | 7/1979 | France . |
| WO79/00770 | 10/1979 | PCT Int'l Appl. . |

OTHER PUBLICATIONS

Brochure Entitled "Kollektion 81/82", of the Kastinger Company of Seewalchen, Austria.

*Primary Examiner*—Louis K. Rimrodt

*Attorney, Agent, or Firm*—Werner W. Kleeman

[57] ABSTRACT

A substantially saddle-shaped pressure pad or restraining member is disposed in the interior of a shell member enclosing the foot region of a ski boot and between the latter and a padded inner shoe. Two cable runs or strands running along each side of the shell member and interconnected to form a single cable element engage the pressure pad. These cable strands pass through the pivot axis of a rear upper portion at two mutually opposed pivot points of this rear upper portion on the lower forward shell member. A tensioning mechanism is mounted on the rear side of this upper rear portion and comprises a tensioning lever which is pivotable about an axis. By pivoting this tensioning lever, the pressure pad can be tensioned or loosened. Since both cable strands pass through the pivot axis of the rear upper portion, the retaining force governed by the tensioning mechanism and applied to the foot of a wearer by the pressure pad is not affected by a pivoting motion of the rear upper portion.

25 Claims, 3 Drawing Figures

ATHLETIC FOOTWEAR, IN PARTICULAR A SKI BOOT

BACKGROUND OF THE INVENTION

The present invention broadly relates to athletic footwear and, more specifically, pertains to a new and improved construction of a ski boot.

Generally speaking, the ski boot of the invention comprises a shell member, a rear upper portion hinged on an axis transverse to the longitudinal axis of the ski boot, and an instep pressure pad or restraining member arranged within the ski boot acting on the upper portion of the user's foot and adjustable by means of a tensioning mechanism or device mounted on the exterior of the heel portion of the boot.

In ski boots with an exterior shell of rigid material in which the foot is inserted from the side or through an aperture in the front portion of the shell, it is known to urge the heel of the foot downwards and towards the rear of the ski boot by means of an instep pressure or retaining device. Significant in this regard are U.S. Pat. Nos. 3,529,368 and 3,599,351. This instep pressure device comprises straps which run over the instep of the foot and whose tension is adjustable, for instance, by means of a buckle connection or a tensioning lever which is mounted on the exterior of the boot.

Such known pressure devices are inconvenient to use and do not permit the user to readily and quickly put on or remove the boot. These known solutions are furthermore not suitable for ski boots which have a rear upper portion mounted in hinged fashion upon the basic shell member.

Ski boots of the latter type are known from the international patent application published as No. WO79/00770 and from U.S. Pat. No. 4,160,332 corresponding to German Pat. Publication No. 27.12.001. These references teach a restraining element running over the instep of the foot and connected to a tensioning mechanism accessible from the exterior of the boot or mounted on the exterior of the rear upper portion of the boot. The tensioning mechanism or the connection between the restraining device and the tensioning mechanism in such known types of ski boot is, however, so arranged that any angular motion of the rear upper portion is directly transmitted to the pressure pad. The result of this coupling is that changes in the angular position of the rear upper portion of the boot change the retaining force exerted on the foot. Bending the lower leg forward results in a forward rotation of the rear upper portion and increases the retention force acting on the foot. Similarly, leaning the lower leg to the rear causes a reduction of this retention force.

This change of the restraining or holding force acting on the foot with each change in the angular position of the lower leg is undesirable since when leaning forward the pressure pad may exert an excessive pressure on the middle region of the foot and when leaning backwards the pressure pad may not exert sufficient force to retain the foot properly within the boot.

When walking longer distances the wearer of the type of boot described above often releases the rear upper portion in order to give the lower leg a greater degree of freedom or even to make it possible to stand in an upright position. Releasing the rear upper portion in this manner is equivalent to rotating it backwards which results in a loosening of the pressure pad for the reasons given above. This means that the foot is no longer adequately retained by the pressure pad and can therefore move within the shell member of the boot which also makes walking difficult.

Other constructions of ski boots are known from U.S. Pat. Nos. 3,530,594 and 3,747,235 and French Pat. No. 2,045,321.

SUMMARY OF THE INVENTION

Therefore, it is a primary object of the present invention to provide a new and improved construction of a ski boot which is not associated with the aforementioned drawbacks and shortcomings of prior art constructions Another and more specific object of the present invention is to provide a ski boot of the type described above in which changes in the retention force exerted upon the foot by the pressure pad are effectively and simply avoided.

These and other objects of the invention are accomplished by arranging and structuring the connecting means between the pressure pad and the tensioning mechanism or device in such manner that the retention force governed by the tensioning mechanism and which is to be exerted on the foot is not influenced by the angular position of the rear upper portion of the boot.

The embodiment of this connection according to the present invention permits the retention force which the wearer sets and considers proper to remain constant, independent of the angular position of the lower leg or of the degree of rotation of the rear upper portion of the boot. The foot is therefore never excessively compressed and also never undesirably loose in the boot. The latter is particularly advantageous in walking since the foot is then sufficiently retained even when the rear upper portion is released to such a degree that the lower leg has the necessary freedom of motion to permit comfortable walking.

The connection between the pressure pad or restraining member and the tensioning mechanism or device which is independent of rotation of the rear upper portion of the boot is achieved by providing at least one and preferably two connecting elements which pass through the pivot axis of the rear upper portion of the boot and preferably in the region of a hinge point of the rear upper portion of the boot on the shell member of the boot.

BRIEF DESCRIPTION OF THE DRAWINGS

The invention will be better understood and objects other than those set forth above, will become apparent when consideration is given to the following detailed description thereof. Such description makes reference to the annexed drawings wherein.

Figure 1:
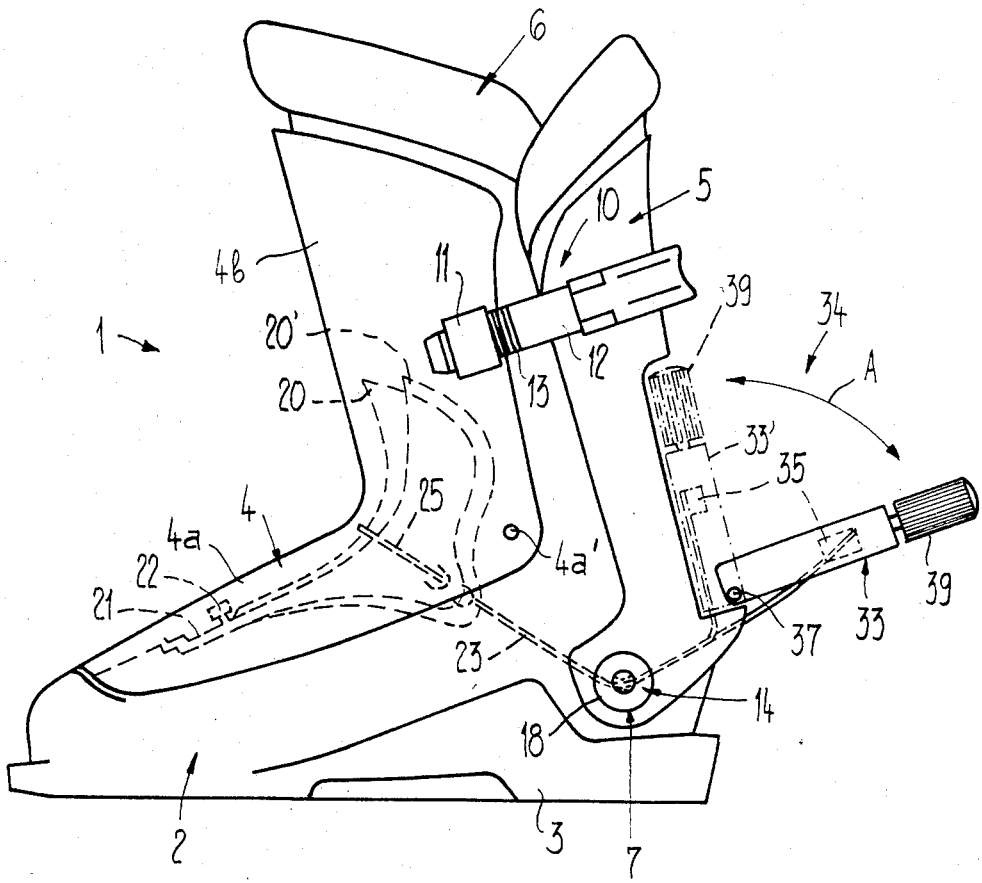
FIG. 1 is a schematic side view of a ski boot with a tensioning lever mounted on the rear upper portion and shown in full lines in the released position and shown in dotted lines in the engaged position.
Figure 2:
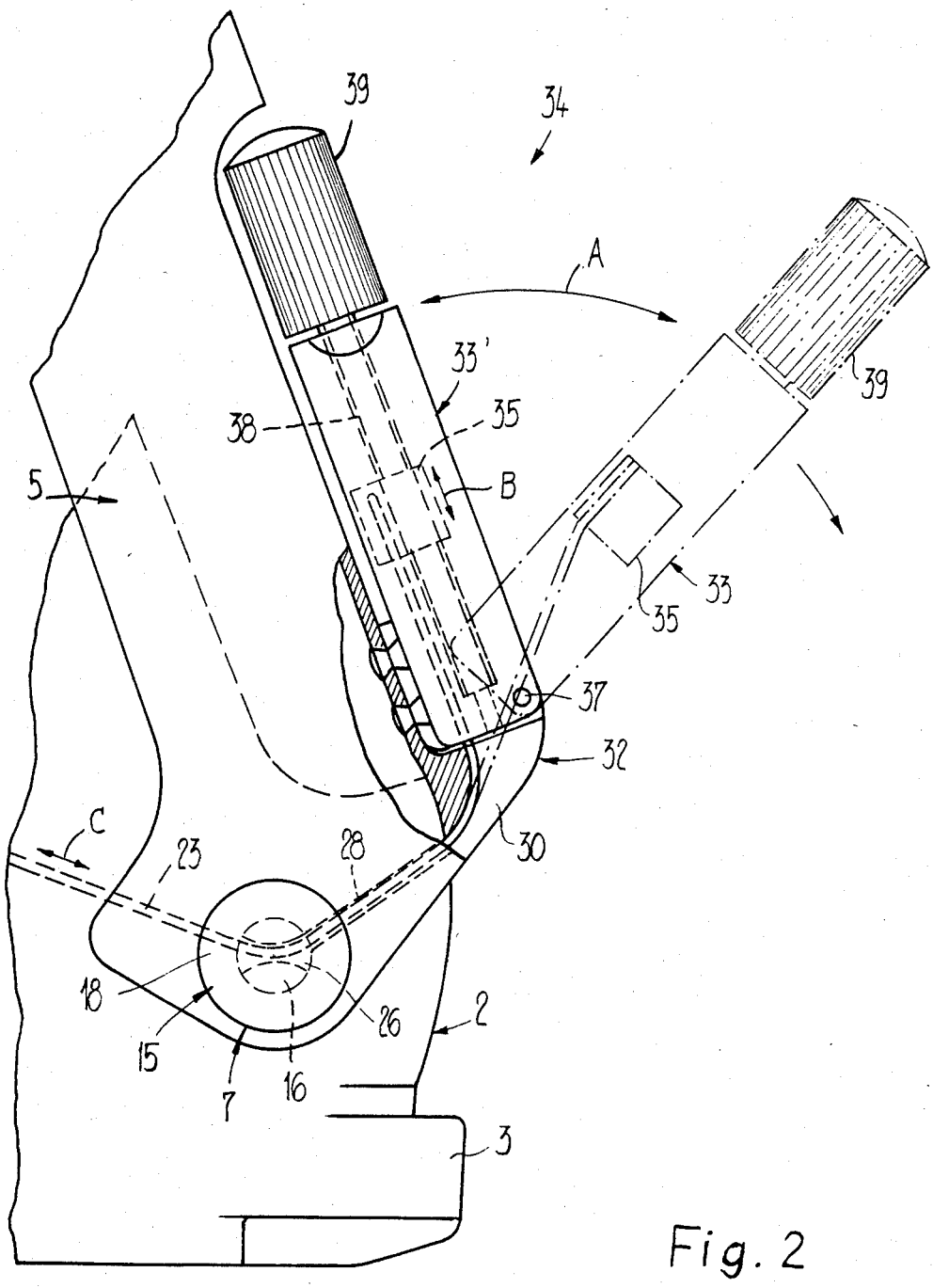
FIG. 2 is a further side view on an enlarged scale showing a portion of the rear upper portion of the boot according to FIG. 1, partly in section.

DETAILED DESCRIPTION OF THE PREFERRED EMBODIMENTS:

In FIG. 1, ski boot 1 has a relatively stiff shell member 2 with a sole 3 surrounding the foot, a tongue part 4 fitting the instep/shin region, and a rear upper portion 5 supporting the heel/calf region. A soft padded inner shoe 6 is arranged within the outer shell formed by the parts described above. Tongue part or portion 4, which comprises a section 4*a* covering the instep and a section 4*b* covering the lower shin region, fits over shell member 2 in the manner of a saddle and is connected to shell member 2 by connecting regions 4*a*'. Section 4*b* of tongue portion 4 is pivotable about the axis defined by both connecting regions 4*a*' permitting section 4*b* to follow the motion of the lower leg of the wearer of the boot.

Figure 3:
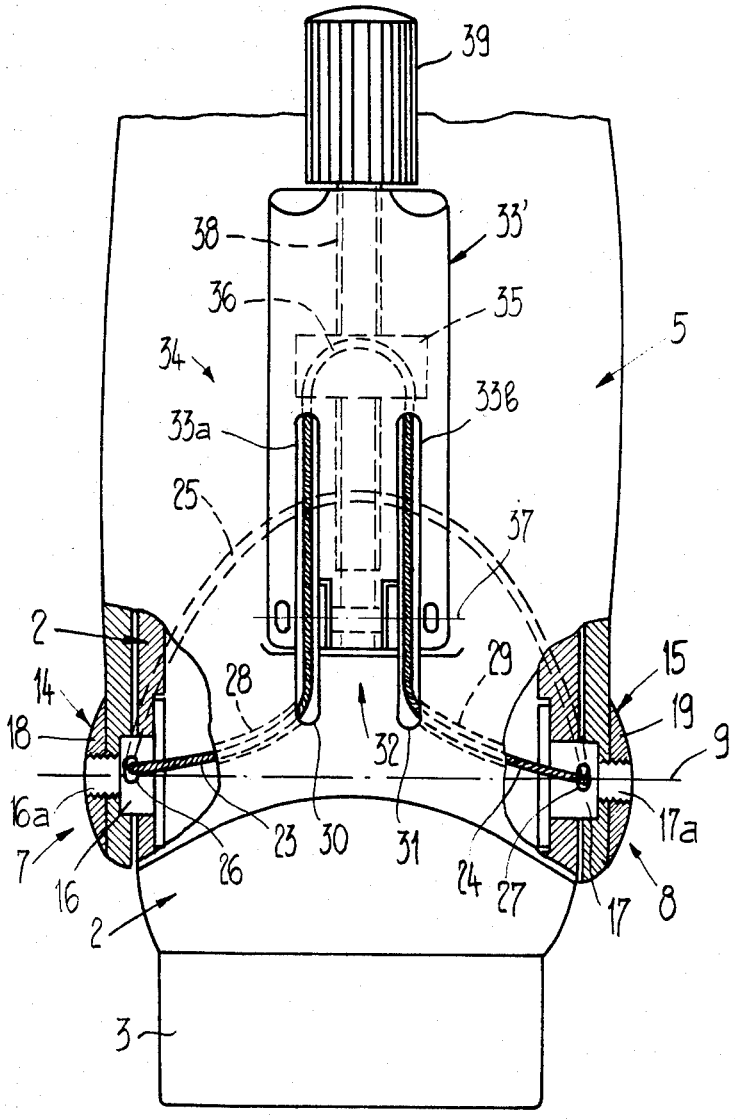
FIG. 3 is rear view of the ski boot according to FIG. 1, partly in section.

Rear heel portion or spoiler 5 is pivotably mounted on both sides of shell member 2 by means of pivot points or hinges 7 and 8 (FIG. 3). The two pivot points or hinges 7 and 8 define the pivot axis 9 of rear upper portion 5 which is transverse and essentially perpendicular to the longitudinal axis of the boot. Rear upper portion 5 of the boot is therefore able to follow the motion of the lower leg of the wearer. Rear upper portion 5 can be connected to the tongue portion 4 by means of closure device 10. Closure device 10 comprises two retaining or retention elements 11 fastened to section 4*b* of tongue portion 4 on opposite sides of the boot, one of which is visible in FIG. 1. Each of these retaining elements 11 engages a connecting strap 12 which is fastened to rear upper portion 5 and whose free end comprises a toothed portion 13. Retaining elements 11 engage the connecting straps 12 by detent or latching action. This connection between rear upper portion 5 and section 4*b* of the tongue portion 4 enables rear upper portion 5 and section 4*b* to jointly follow leg motions of the wearer.

The configuration of pivoted or hinge connection 14, 15 between shell member 2 and rear upper portion 5 is shown in FIG. 3. Each of these pivoted or hinge connections 14, 15 has a hinge pin 16, 17 extending along pivot axis 9 and provided with threads 16*a*, 17*a* at their outer ends. Nuts 18, 19 are screwed onto threads 16*a*, 17*a* from the exterior side of the boot.

In the interior of shell member 2 and on the upper side of inner shoe 6 there is a substantially saddle-shaped pressure pad or restraining member 20 which acts on the user's foot in a manner to be described below. The end of pressure pad 20 nearest the toe of the boot is provided with a longitudinal slot 21 which engages a pin 22 mounted on shell member 2 of the ski boot. Pressure pad 20 is thus mounted on shell member 2 in such a manner that it has a certain degree of freedom to move in the longitudinal direction of the boot. Two cable runs or strands 23 and 24 (see also FIG. 3) run down opposing interior sides of shell member 2 and are connected to one another in the region of pressure pad 20 by a substantially arc-shaped connecting piece or element 25 which runs or extends over pressure pad 20. The cable strands 23 and 24 on the interior of shell member 2 pass through related apertures or bores 26 and 27 in their associated pivot pins 16 and 17 and thence through conduits or channels 28 and 29 provided in rear upper portion 5 up to slits or slots 30 and 31 provided in buttress or counter support 32 mounted on rear upper portion 5 of the boot. After exiting the conduits or channels 28, 29 the cable strands 23 and 24 of the cable structure run in these slits 30, 31 in buttress 32 and thence in parallel, longitudinally adjacent slits or slots 33*a*, 33*b* of a tensioning lever 33. The latter is part of a tensioning mechanism or device 34 which further comprises an anchoring or attachment element 35 for the cable runs or strands 23 and 24 in the interior of tensioning lever 33.

As can be seen in FIG. 3, both of the cable strands 23 and 24 are also connected to one another in the region of anchoring or attachment element 35 by means of a substantially arc-shaped connecting piece or element 36 which anchors the cable strands 23, 24 to anchoring element 35. The two cable strands 23, 24 therefore form in conjunction with connecting pieces or elements 25 and 36 a single loop of cable or cable structure. Connecting piece or element 36 passes through anchoring or attachment element 35 in such manner that it is free to shift. This permits equalization of the tension forces in the cable strands 23 and 24.

Tensioning lever 33 whose longitudinal axis lies essentially in the longitudinal median plane of ski boot 1, is pivotably fastened to the buttress or counter support 32 on transverse axis or pivot shaft 37 which extends essentially perpendicular to the longitudinal axis of the boot. A threaded spindle 38 extends along the longitudinal axis of tensioning lever 33 in its interior and engages anchoring or attachment element 35. At its upper end this threaded spindle 38 is provided with a knurled knob with which threaded spindle 38 can be turned.

When threaded spindle 38 is appropriately turned, the anchoring or attachment element 35 selectively moves along the threaded spindle 38 in the direction of the double-headed arrow B (FIG. 3). This motion of anchoring element 35 results in a change in length of those sections of the cable strands 23 and 24 which lie between anchoring element 35 and the apertures or bores 26, 27 in pivot pins 16, 17. Correspondingly, the length of the cable sections between apertures 26 and 27 and pressure pad 20 also changes. By displacing anchoring element 35 and thus entraining a motion of the cable strands 23 and 24 in the direction of arrow C (FIG. 3), the force that the pressure pad 20 exerts against the inner shoe 6 and the foot within it, that is the foot retention force, can be adjusted by appropriately operating tensioning lever 33. By pivoting tensioning lever 33 the pressure pad 20 can be tensioned or loosened. When tensioning lever 33 is in its released position in which it is pivoted away from rear upper portion 5 as shown in FIG. 3, the pressure pad assumes the location designated as 20 in FIG. 1. When tensioning lever 33 is moved from its released position in the direction of arrow A into the tensioning position in which it is adjacent to rear upper portion 5, the pressure pad is drawn into its active position designated 20' in FIG. 1.

Since both cable strands 23, 24 pass through pivot pins 16, 17 and therefore pivot axis 9 of rear upper portion 5, the angular position of rear upper portion 5 can have no influence on the loading condition of pressure pad 20. That means that the force with which pressure pad 20 retains the foot and which is governed by tensioning mechanism 34, remains constant even when rear upper portion 5 is pivoted forward or backward.

In order to be able to introduce the user's foot into the ski boot 1, the closure device 10 is released and the rear upper portion 5 of the boot is pivoted backwards until the boot entrance opening or aperture becomes large enough to accommodate the foot. To facilitate inserting the foot into the boot, it is advantageous to loosen pressure pad 20 by pulling tensioning lever 33 backward into its released position. After pushing the rear upper portion 5 forward and engaging closure device 10, the threaded spindle 38 is turned or rotated until pressure pad 20 exerts a force on the foot which the wearer considers desirable or proper. Tensioning lever 33 is then pushed back into its closed position in which it is maintained by eccentric action i.e. by moving through its dead-center position. In order to properly adjust the retention or restraining force exerted by pressure pad 20, it may be necessary to repeat the adjustment procedure described above.

As already mentioned, once the retention force has been adjusted by means of tensioning mechanism or device 34, it remains essentially constant regardless of any changes in the angular position of the lower leg which necessarily arise in skiing, walking or standing. To permit comfortable standing and walking, the closure device 10 is often released to permit rear upper portion 5 to move backward by a certain amount so that the lower leg may assume an upright position. In this slightly opened position of rear upper portion 5, the predetermined retention effect of pressure pad 20 remains constant for the reasons given above. Therefore, the foot is properly retained within the ski boot 1 when walking, which prevents an unpleasant rubbing of the heel or instep region of the foot upon the relatively stiff shell member 2 of the ski boot.

To take the boot off, the same steps or manipulations are applied in reverse, that is the tensioning lever 33 is first pulled into its released position and then the closure device 10 is opened. Depending on the tension force acting on pressure pad 20 and the ensuing restriction of the opening for withdrawing the instep of the wearer's foot, it may also be possible to put on and take off the ski boot 1 without pulling tensioning lever 33 into its released position. The possibility of pivoting the rear upper portion 5 of the ski boot according to the present invention permits introducing the foot from the rear which renders it far more convenient than boots which have to be entered from the side or even from the front.

Although the described arrangement of the cable runs or strands 23, 24 in conduits 28, 29 and slits 30, 31, 33*a* and 33*b*, has the particular advantage of protecting these cable strands 23 and 24 of the traction cable structure, it is also possible to provide other guide arrangements for these cable strands 23 and 24. Furthermore, it is conceivable not to connect the cable strands 23 and 24 together in the region of pressure pad 25 or in the region of anchoring or attachment element 35. Such an arrangement with two individual cable strands 23 and 24 has, in comparison with the embodiment described, the disadvantage that unequal traction forces on the cable strands 23 and 24 can no longer be equalized by simple means. In a further possible embodiment, a single cable or cable strand 23 or 24 might be provided, meaning that pressure pad 20 would have to be fastened to shell member 2 on the opposite side of the boot. This embodiment does not have the advantage of a substantially symmetrical arrangement of the loop-like traction cable structure 23, 24, 25, 36 and tensioning mechanism 34.

Instead of fixing the cable strands 23 and 24 to an anchoring element 35 whose position may be continuously or infinitely adjusted by means of a threaded spindle 38 or the like, it is also possible to provide a series of detent hooks or latches on tensioning lever 33 arranged one above another along its longitudinal axis and in which the connecting part 36 of the cable strands 23 and 24 may be selectively engaged.

While there are shown and described present preferred embodiments of the invention, it is to be distinctly understood that the invention is not limited thereto, but may be otherwise variously embodied and practiced within the scope of the following claims.

Accordingly, what I claim is:

1. An article of athletic footwear, especially a ski boot having a longitudinal axis and comprising:

a shell member;

a rear upper portion having an outer side and cooperating with said shell member;

pivot means for mounting said rear upper portion on said shell member for pivotal movement about a pivot axis extending substantially perpendicular to the longitudinal axis of the boot;

a pressure pad arranged within the shell member of the boot and intended to act upon the foot of the wearer;

tensioning means attached to said rear upper portion at said outer side for forcing the pressure pad against the foot of the wearer; and connecting means arranged between the pressure pad and the tensioning means constructed such that the force governed by the tensioning means and acting upon the foot of the wearer is substantially independent of the angular position of the rear upper portion of the boot.

2. The article of athletic footwear according to claim 1, wherein:

the connecting means connecting the pressure pad with the tensioning means passes through the pivot axis of the rear upper portion.

3. The article of athletic footwear according to claim 2, wherein:

the connecting means comprises two connecting elements which run on each side of the boot and each passing through said pivot axis of the rear upper portion.

4. The article of athletic footwear according to claim 3, wherein:

the rear upper portion is connected to the shell member by said pivot means at two mutually opposed pivot points;

said pivot means comprising two pivot pins located on opposite sides of said rear upper portion and defining said two mutually opposed pivot points;

each pivot pin having an aperture for receiving a related one of said two connecting elements; and the connecting elements passing through said apertures of the pivot pins of the pivot elements.

5. The article of athletic footwear according to claim 3, further including:

means for interconnecting both of the connecting elements with one another in the region of the pressure pad.

6. The article of athletic footwear according to claim 3, wherein:

the tensioning means is provided with means for engaging the connecting means;

means for selectively adjusting the position of said engaging means; and means for interconnecting the connecting elements with one another in the region of the engaging means.

7. The article of athletic footwear according to claim 6, wherein:

the tensioning means comprises a tensioning lever provided with said engaging means for the connecting means.

8. The article of athletic footwear according to claim 7, wherein:

said engaging means comprises an anchoring element slideably mounted in said tensioning lever.

9. The article of athletic footwear according to claim 8, further including:

means for pivotably mounting the tensioning means on the rear upper portion of the boot about an axis transverse to the longitudinal axis of the boot.

10. The article of athletic footwear according to claim 8, wherein:

said selectively adjusting means serves for altering the length of the connection means between a point where the connection means crosses the pivot axis of the rear upper portion and the anchoring element.

11. The article of athletic footwear according to claim 10, wherein:

the selectively adjusting means cooperates with the anchoring element in order to change its position along a longitudinal axis of the tensioning lever.

12. The article of athletic footwear according to claim 11, wherein:

the selectively adjusting means comprises a threaded spindle disposed within the tensioning lever and provided with a knob; and the threaded spindle cooperates with the anchoring element to alter its position.

13. The article of athletic footwear according to claim 12, wherein:

said tensioning lever has a free end; and said knob is arranged at said free end of said tensioning lever.

14. The article of athletic footwear according to claim 2, wherein:

the connecting means comprises two connecting elements which run on each side of the boot and each passing through said pivot axis of the rear upper portion at a pivot point of the latter upon the shell member.

15. The article of athletic footwear according to claim 2, wherein:

the rear upper portion is connected to the shell member by said pivot means at two mutually opposed pivot points;

16. The article of athletic footwear according to claim 2, wherein:

the rear upper portion is provided with at least one conduit for accommodating the connecting means; and the connecting means is disposed within said conduit.

17. The article of athletic footwear according to claim 16, wherein:

said at least one conduit extends to pivot points of the rear upper portion.

18. The article of athletic footwear according to claim 16, wherein:

said connecting means comprises two connecting elements;

the rear upper portion is provided with two conduits for accommodating the connecting elements; and said connecting elements are disposed within the conduits.

19. The article of athletic footwear according to claim 18, wherein:

each of said conduits extend to pivot points of the rear upper portion.

20. The article of athletic footwear according to claim 1, wherein:

the connecting means connecting the pressure pad with the tensioning means passes through the pivot axis of the rear upper portion at a pivot point of the pivot means of the rear upper portion on the shell member.

21. The article of athletic footwear according to claim 1, further including:

fastening means provided for the boot; and the pressure pad is provided with means for engaging said fastening means in a manner permitting motion thereof in a longitudinal direction of the boot.

22. The article of athletic footwear according to claim 21, wherein:

said fastening means is provided at said shell member.

23. The article of athletic footwear according to claim 1, wherein:

the tensioning means is provided with means for engaging the connecting means; and means for selectively adjusting the position of said engaging means.

24. The article of athletic footwear according to claim 23, wherein:

the tensioning means is provided with at least two spaced means for engaging the connecting means; and the spaced engaging means being spaced apart from one another in the lengthwise direction of the tensioning means.

25. An article of athletic footwear, especially a ski boot having a longitudinal axis and comprising:

a shell member;

a rear upper portion having an outer side and cooperating with said shell member;

pivot means for mounting said rear upper portion on said shell member for pivotal movement about a pivot axis extending substantially perpendicular to the longitudinal axis of the boot;

a pressure pad arranged within the shell member of the boot and intended to act upon the foot of the wearer;

tensioning means attached to said rear upper portion at said outer side for forcing the pressure pad against the foot of the wearer;

connecting means arranged between and interconnecting said tensioning means and said pressure pad; and said connecting means passing through said pivot axis of said rear upper portion such that the force governed by said tensioning means and acting upon the foot of the wearer is substantially independent of the angular position of said rear upper portion of the boot.

* * * * *

UNITED STATES PATENT AND TRADEMARK OFFICE

CERTIFICATE OF CORRECTION

PATENT NO. : 4,539,763

DATED : September 10, 1985

INVENTOR(S) : KLAUS WALKHOFF

It is certified that error appears in the above—identified patent and that said Letters Patent is hereby corrected as shown below:

Column 7, please insert the following subparagraphs after line 5 of claim 15:

--said pivot means comprising at least one pivot pin having an aperture; and said connection means passing through said aperture of said at least one pivot pin of said pivot means.--

Signed and Sealed this

*Twenty-sixth* Day of *November 1985*

[SEAL]

*Attest:*

DONALD J. QUIGG

*Attesting Officer*

*Commissioner of Patents and Trademarks*